US007540042B2

(12) United States Patent
Chen

(10) Patent No.: US 7,540,042 B2
(45) Date of Patent: Jun. 2, 2009

(54) SITTING AND SLEEPING FURNITURE

(76) Inventor: Fengchun Chen, Minglounanqu, Jiangdong District, Room 303, No. 5, 59 Nong, Huazhong Street, Ningbo (CN) 315040

( * ) Notice: Subject to any disclaimer, the term of this patent is extended or adjusted under 35 U.S.C. 154(b) by 0 days.

(21) Appl. No.: 11/965,785

(22) Filed: Dec. 28, 2007

(65) Prior Publication Data

US 2008/0098519 A1 May 1, 2008

Related U.S. Application Data

(63) Continuation of application No. PCT/CN2006/001277, filed on Jun. 12, 2006.

(30) Foreign Application Priority Data

Jun. 30, 2005 (CN) ..... 2005 2 0012900 U

(51) Int. Cl.
*A47C 17/04* (2006.01)

(52) U.S. Cl. ..... 5/37.1; 5/47; 5/927

(58) Field of Classification Search ..... 5/37.1, 5/47–48, 13, 927

See application file for complete search history.

(56) References Cited

U.S. PATENT DOCUMENTS 3,458,877 A * 8/1969 Edwards ..... 5/47

* cited by examiner

*Primary Examiner*—Fredrick Conley
(74) *Attorney, Agent, or Firm*—Matthias Scholl P.C.; Matthias Scholl

(57) ABSTRACT

The present invention teaches a sitting and sleeping furniture with arbitrarily adjustable inclination, comprising: a back (10), a sitting and sleeping platform (13), a plurality of back columns (2), a back column cross frame (5), and a plurality of sitting and sleeping platform frames (14), the back columns (2) is connected with the back column cross frame (5) to form back column framework, the sitting and sleeping platform frames (14) are connected with the back framework to form a sitting and sleeping platform skeleton, wherein a parallel mechanism is set at the position below the bottom of the back and above the sitting and sleeping platform (13) containing a lead screw or roundabout pulling rope (31), and a hydraulic or pneumatic cylinder or a worm controller serving to control the supporting arm; and a synchronous lifting mechanism serving to cooperate with the parallel mechanism to keep the top of the back be parallel with the bottom of the back is set on the upper side of the back (10).

9 Claims, 15 Drawing Sheets

SITTING AND SLEEPING FURNITURE

CROSS-REFERENCE TO RELATED APPLICATIONS

This application is a continuation of International Patent Application No. PCT/CN2006/001277, with an international filing date of Jun. 12, 2006, designating the United States, now pending, which is based on Chinese Patent Application No. 200520012900.4, filed Jun. 30, 2005. The contents of the aforementioned specifications are incorporated herein by reference.

BACKGROUND OF THE INVENTION

Field of the Invention

The present invention relates to furniture, and specifically, to a sitting and sleeping furniture with an arbitrarily adjustable back inclination. It can be used as a chair, a couch, a sofa, and particularly as a bed placed against a wall.

Indoor decoration of a modern bedroom generally includes a television because people like to watch TV on the bed, some people also like reading on the bed. Since the back of the bed is fixed and thus its inclination can not be adjusted, a back cushion is often used to compensate for the comfortability when people is watching TV or reading. However, an arbitrarily wanted inclination is difficult to obtain and thus a comfortable back rest can not be achieved. Though various conventional chairs and couches offer an adjustable back inclination, they are not suitable for being placed against a wall. For example, there is a kind of couch that has a rotatable shaft between its back and the sitting and sleeping platform, and the height of the back is adjustable. When the back is adjusted to a lower position, the upper side of the back moves backward; when the back is adjusted to a higher position, then the upper side of the back moves forward. However, the forward movement of the back shortens the distance to watch the front sceneries; when the back moves backward, for a couch, if the couch can not be placed against the wall, it has to be moved against the wall to leave a space between them, which causes the room disordered; for a bed, due to the limitation of room space, the movement of the bed even can not be realized, moreover, the movement of the bed also shortens the distance to watch TV. Besides, bed with adjustable inclination is also available, but the adjustment of the bed is also realized by adjusting the headboard portion of the bed, so that above problems also exist; moreover, when the headboard portion of the bed is moved upward, the spring mattress will also move upward, which is inconceivable. Two China patents with application numbers of ZL94209103.5 and ZL03273833.1 disclosed an apparatus similar to a back board set at the back position of the bed, at normal time, the back board is placed parallel to the headboard and vertical to the bed platform, when adjusting the inclination of the back, the back board can be lifted from the bottom to form an inclination with the bed platform. In this way, though some of the problems are solved, since the back board is lifted by rotating around the upper end of the back board, the upper side of the back board can not be lowered all the time, so when in use, the upper side is too high, more seriously, the lower end of the back board is not connected with the bed platform so that comfortable back rest can not be realized.

SUMMARY OF THE INVENTION

Therefore, it is an objective of the present invention to solve above problems and thus to provide a sitting and sleeping furniture with an arbitrarily adjustable back inclination that can be placed against a wall, and when adjusting the inclination, the bottom of the back keeps parallel to the sitting or sleeping platform all the time, while the top of the back can be lifted synchronously to keep it being parallel with the bottom of the back.

In order to realize the above objective, there is provided a sitting and sleeping furniture, comprising a back, a sitting and sleeping platform, a plurality of back columns, a back column cross frame, a plurality of sitting and sleeping platform frames, said back columns are connected via the back column cross frame to form a back framework for housing the back, said sitting and sleeping platform frames are connected with the back framework to form a skeleton for housing the sitting and sleeping platform, wherein a parallel mechanism is set above the sitting and sleeping platform and at the lower end of the back and a synchronous lifting mechanism is set at the upper end of the back to engage with the parallel mechanism.

In certain embodiments of the present invention, said parallel mechanism set above the sitting and sleeping platform and at the lower end of the back comprises a pair of supporting arms and a supporting arm controller; said synchronous lifting mechanism set at the upper end of the back comprises components for connecting the two upper sides of the back and capable of being operated on the two back columns.

In certain embodiments of the present invention, the supporting arm for the parallel mechanism above the sitting and sleeping platform and at the lower end of the back can be a horizontal mono supporting arm or a horizontal hinge folding supporting arm, and also can be a stand supporting arm; the supporting arm controller for the parallel mechanism above the sitting and sleeping platform and at the lower end of the back can be a lead screw controller; or a roundabout pulling rope controller; or a hydraulic or pneumatic cylinder controller; or a worm controller.

In certain embodiments of the present invention, said parallel mechanism can be configured in such a way that the end of the horizontal mono supporting arm at each side of the back column cross frame is hinged with the left and right hinges at the lower end of the back framework, respectively, the top end of the rotating shaft at the other end of the horizontal mono supporting arm is installed with a left-handed thread lead screw nut and a right-handed thread lead screw nut, respectively, which can be engaged with the left and right lead screw controllers at the lower end of the back. Optionally, said parallel mechanism can be configured in such a way that the end of the horizontal mono supporting arm at each side of the back column cross frame is connected with the left and right hinges at the lower end of the back framework, respectively, the left and right guide sleeves at the top of each rotating shaft at the other end of the horizontal mono supporting arms is engaged with the cross frames at the lower end of the back, said left and right guide sleeves are tied to the roundabout pulling rope controller managed by a gear at one side of the lower end of the back.

In certain embodiments of the present invention, optionally, said parallel mechanism can be configured in such a way that the end of the horizontal mono supporting arm at each side of the back column cross frame is hinged with the left and right hinges at the lower end of the back framework, respectively, the left and right guide sleeves at the top of each rotating shaft at the other end of the horizontal mono supporting arms is connected with the cross guide columns at the lower end of the back, the left and right cylinder column ends of the two-way horizontal hydraulic or pneumatic cylinder controller set on the back cross frame are hinged with the left and right connecting rods, the other ends of the left and right connecting rods are engaged with the hinges at the upper joint position of the horizontal mono supporting arm and the left and right hinges at the lower end of the back framework or engaged with the tails of the left and right hinges connected with the horizontal mono supporting arm. Optionally, said parallel mechanism can be configured in such a way that the end of the horizontal mono supporting arm at each side of the back column cross frame is hinged with the left and right hinges at the lower end of the back framework, a left-handed worm wheel and a right-handed worm wheel are located outside of the spindle for the hinges engaged with the horizontal mono supporting arm and located at each side of the back, and is engaged respectively with the left lead screw controller and the right lead screw controller at the sides of the worm shaft located on the back column cross frame.

In certain embodiments of the present invention, optionally, said parallel mechanism can be configured in such a way that the end of the horizontal hinge folding supporting arm at each side of the back column cross frame is hinged with the left and right hinges at the lower end of the back framework, respectively, the left and right guide sleeves at the top end of the rotating shaft at the other end of the horizontal hinge folding supporting arm is engaged with the cross guide columns at the lower end of the back, the left and right cylinder column ends of the two-way horizontal hydraulic or pneumatic cylinder controller set on the back cross frame are hinged with the left and right connecting rods, the other ends of the left and right connecting rods are engaged with the hinges at the upper joint position of the horizontal hinge folding supporting arm and the left and right hinges at the lower end of the back framework or engaged with the tails of the left and right hinges at the lower end of the back framework hinged with the horizontal hinge folding supporting arm. Optionally, said parallel mechanism can be configured in such a way that the end of the horizontal hinge folding supporting arm at each side of the back column cross frame is hinged with the left and right hinges at the lower end of the back framework, a left-handed worm wheel and a right-handed worm wheel are located outside of the spindle for the hinges engaged with the horizontal hinge folding supporting arm and located at the sides of the back, and are engaged respectively with the left lead screw controller and the right lead screw controller at the sides of the worm shaft located on the back column cross frame.

In certain embodiments of the present invention, optionally, one end of the horizontal mono supporting arm is hinged with the vertical hinge at the middle of the back column cross frame, the lead screw nut at the top end of the rotating shaft at the other end is engaged with the lead screw controller at the lower end of the back. Optionally, one end of the horizontal mono supporting arm is hinged with the vertical hinge at the middle of the back column cross frame, the guide sleeve at the top end of the rotating shaft at the other end is engaged with the guide column at the lower end of the back, said guide sleeve is tied to the roundabout pulling rope controller managed by a gear at one side of the lower end of the back. Optionally, the guide sleeve at the top end of the rotating shaft at the other end is engaged with the guide column at the lower end of the back, or the top end of the rotating shaft at one end of the horizontal hinge folding supporting arm is engaged with the hinge at the middle of the lower end of the back, the other end of the supporting arm can be engaged with the vertical hinge at the middle of the back column cross frame, the worm wheel outside of the spindle for the vertical hinge of said supporting arm is engaged with the worm controller parallel to the supporting arm. Optionally, the top end of the stand supporting arm is engaged with the hinge at the middle of the backside of the back, the bottom end is engaged with the horizontal hinge at the middle of the back column cross frame, the worm wheel located outside of the spindle for said horizontal hinge is engaged with the worm controller. Optionally, the guide sleeve at the top end of the rotating shaft at one end of the horizontal mono supporting arm is engaged with the guide column at the lower end of the back, said guide sleeve is tied to the roundabout pulling rope controller managed by a gear at one side of the lower end of the back; or the top end of the rotating shaft at one end of the horizontal hinge folding supporting arm is engaged with the hinge at the middle of the lower end of the back; or the top end of the stand supporting arm is engaged with the hinge at the middle of the backside of the back; the other end of each of the three supporting arms is engaged with the hinge at the middle of the back column cross frame, respectively, the cylinder column end of the one-way hydraulic or pneumatic cylinder controller is hinged with one end of the connecting rod, the other end of said connecting rod is engaged with the hinges at the upper joint position of the supporting arm and the hinge at the middle of the back column cross frame or engaged with the tails of the hinge at the middle of the back column cross frame. As for the driven source for the controller in above said parallel mechanism, said lead screw, roundabout pulling rope, and worm controllers are driven by a manual disc or handle, or driven by a motor; said one-way or two-way hydraulic or pneumatic cylinder controller is driven by a manual or electrical hydraulic or pneumatic pump.

In certain embodiments of the present invention, when the parallel mechanism of the present invention drives the bottom of the back to be parallel with the sitting and sleeping platform, the synchronous lifting mechanism drives the top of the back to be parallel with the bottom of the back. Said synchronous lifting mechanism is configured in such a way that the cross T-shape guide column above the back runs in the guide way at the inner side of the back column. Optionally, one end of the hinge shaft above each side of the back is connected with a pulley yoke, the pulleys at the two ends of said pulley yoke run in the guide way at the inner side of the sides of the back column. Optionally, the square shell hinge above each side of the back is dynamically housed in the inner cavity of the hinge shell, the pulleys at the ends of the hinge shaft run in the guide way at the inner side of the back column. A back compression spring and an inclination push block engaging with an inclination back column lock are disposed between said square shell hinge and the back, a return compression spring is set on the back column lock. Optionally, the top end at each side of the back is engaged with the pulley yoke, the parallel pulley runs in the guide way relative to the backside of the back, said pulley yoke is set with a cam lock spanner to lock the guide way. Optionally, the top end at each side of the back is engaged with the hinge at the top of the back guide column, the guide column is inserted into the inner side of the back column, an axial operated pulley is set between the bottom end of said guide column and the top of the back column.

In accordance with the present invention, to provide more comfort for the user to lean on the inclined back, an adjusting apparatus for adjusting the pillow support is set at the upper side of the back. Said apparatus is configured in such a way that the bottom of the pillow support is engaged with the hinge at the front of each upper side of the back, a R-shaped support tooth segment rotating with the hinge is set below the backside of the pillow support, said R-shaped support tooth segment is set with an support top segment for housing the spring; or the bottom end of the pillow support is engaged with the drawer type guide way at the upper side of the back, a plurality of parallel support tooth segments are set between the guide way, said parallel support tooth segment is set with support top segment for housing the spring; or the bottom end of the pillow support is engaged with the hinge in front of the upper side of the back, the bottom end at the back side of the pillow support is hinged with connecting rods, the other end of said connecting rod is engaged with a one-way hydraulic or pneumatic cylinder column end.

In accordance with the present invention, to satisfy the needs to adjust the thickness of the mattress based on the weather change, an adjusting apparatus to adjust the distance between the bottom of the back and the sitting and sleeping platform is set at the two ends of said back column cross frame, said apparatus is configured in such a way that an cover having an opening to match with the back column is set at the two ends of the back column cross frame, a plurality of fasteners is set at the two sides of the opening of the cover; optionally, a sleeve that is dynamically matched with the back column is set at the two ends of the back column cross frame, said sleeve is opened with a gear cavity to engage with the synchronous gear wheel connected by shafts, said synchronous gear wheel can be geared with the spur rack set on the back column, said sleeve is installed with a positioning cam spanner to adjust the distance between the bottom of the back and the sitting and sleeping platform.

In accordance with the present invention, in order to offer more flexibility to fit for various users, more than one back that can be adjusted independently can be set on the sitting and sleeping furniture. This configuration can be realized in such a way that at least one back column having two-path guide way can be added between said back columns at the two sides, the bottom of said two-path guide way back column is connected with the back column cross frame, two paratactic backs are set between said two-path guide way back column and each back column, and can have a separate parallel mechanism or share the same parallel mechanism. Optionally, two or more two-path guide way back columns can be set on the sitting and sleeping furniture, and thus more than three backs can be added.

In accordance with the present invention, by combining the parallel mechanism set to adjust the bottom of the back to be parallel with the sitting and sleeping platform and the synchronous lifting mechanism set to adjust the top of the back to be parallel with the bottom of the back, the problem of adjusting the back inclination when the furniture is placed against a wall is solved, and thus a satisfied back with an arbitrarily adjustable inclination is provided. It can be used widely and has a good practicality, and it has a simple structure and is easy to operate, and can be operated manually or electrically.

BRIEF DESCRIPTION OF THE DRAWINGS

FIGS. 9-15 are partial structural views of five kinds of synchronous lifting mechanism of the present invention, wherein FIG. 9 and FIG. 15 are back views, FIGS. 10-11 and FIGS. 13-14 are top views, and FIG. 12 is a side view.

DETAILED DESCRIPTION OF THE EMBODIMENTS

The present invention will hereinafter be described further according to the embodiments and drawings.

Embodiment 1

Figure 1:
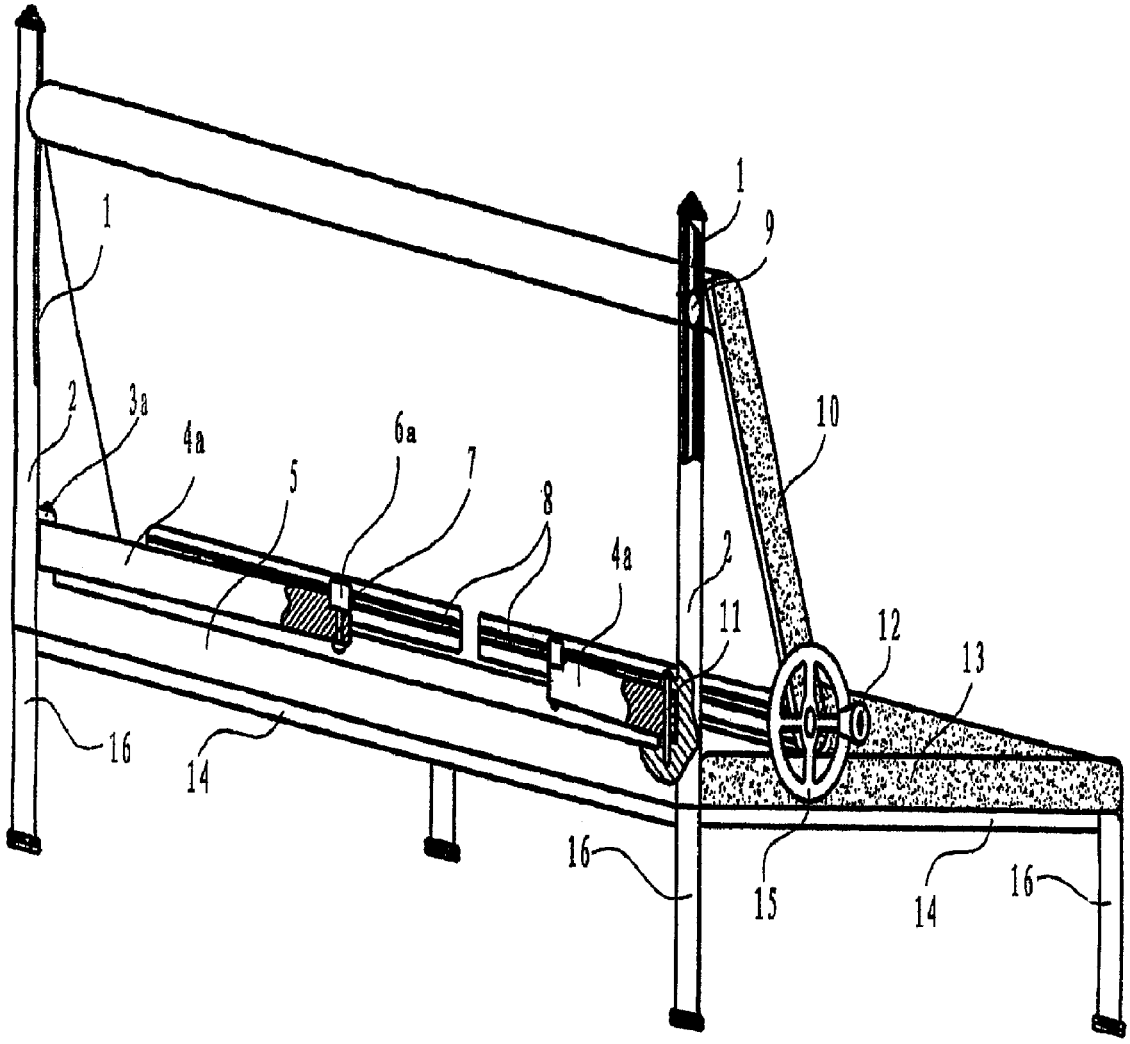
FIG. 1 illustrates a perspective view of a sitting and sleeping furniture of the present invention, where the parallel mechanism is a pair of lead screw controlled left and right horizontal mono supporting arms; the synchronous lifting mechanism is a T-shaped guide column running in the guide way at the inner side of the back column.

FIGS. 1-18 illustrate the embodiments of the present invention, including multiple replaceable or applicable choices for some partial structures, comprising: a back 10, a sitting and sleeping platform 13, a pair of back columns 2, a back column cross frame 5, a plurality of sitting and sleeping platform frames 14, said back columns 2 are connected via the back column cross frame 5 to form a back framework for housing the back 10, said sitting and sleeping platform frames 14 serves to connect the back framework to form skeleton for accommodating the sitting and sleeping platform 13, wherein a straight parallel mechanism is set below the back 10 and above the sitting and sleeping platform 13 and a synchronous lifting mechanism is set at the upper side of the back 10 to keep the top of the back 10 be parallel with the bottom of the back 10. Said parallel mechanism can be configured in such a way that one end of each horizontal mono supporting arm **4*a* at the two sides of the back column cross frame 5 is engaged with the shaft 11 of the left and right vertical hinges 3*a* at the lower side of the back framework, the top end of the rotating shaft 7 at the other end of each supporting arm 4*a* is set respectively with a left-handed thread lead screw nut and a right-handed thread lead screw nut 6*a* engaged in the left and right thread lead screw 8 controller below the back 10. One side of said left and right thread lead screw 8 is a left-handed thread, while the other said is a right-handed thread. Any end of the lead screw 8 can be operated manually by a disc 15 or a handle 12, or electrically by a motor. Said synchronous lifting mechanism can be configured in such a way that the T-shaped cross guide column 9 at the upper side of each side of the back 10 runs in the guide way 1 at the inner side of each back column 2. A plurality of legs 16 is set below the sitting and sleeping platform skeleton (as shown in FIG. 1). Rotating clock-wise the handle 12 or the disc 15, the left and right thread nuts 6***a* move outward with the rotation of the left and right thread lead screw 8. The outward movement of the left and right nuts 6*a* open gradually the left and right horizontal mono supporting arms, respectively. The gradual open of the horizontal mono supporting arm 4*a* drives the bottom of the back 10 to move parallel forward gradually above the sitting and sleeping platform. Meanwhile, the T-shaped cross guide column 9 slides downward synchronously in the guide way 1 at the inner side of each back column 2 so as to keep the top of the back 10 be parallel with the bottom of the back 10. Rotating anti-clockwise the handle 12 or the disc 15, the left and right thread nuts 65 then move inward on the lead screw 8, at this time, the bottom of the back 10 moves parallel backward gradually, and the top of the back 10 moves upward synchronously. Therefore, the inclination of the back 10 can be adjusted arbitrarily.

Figure 2:
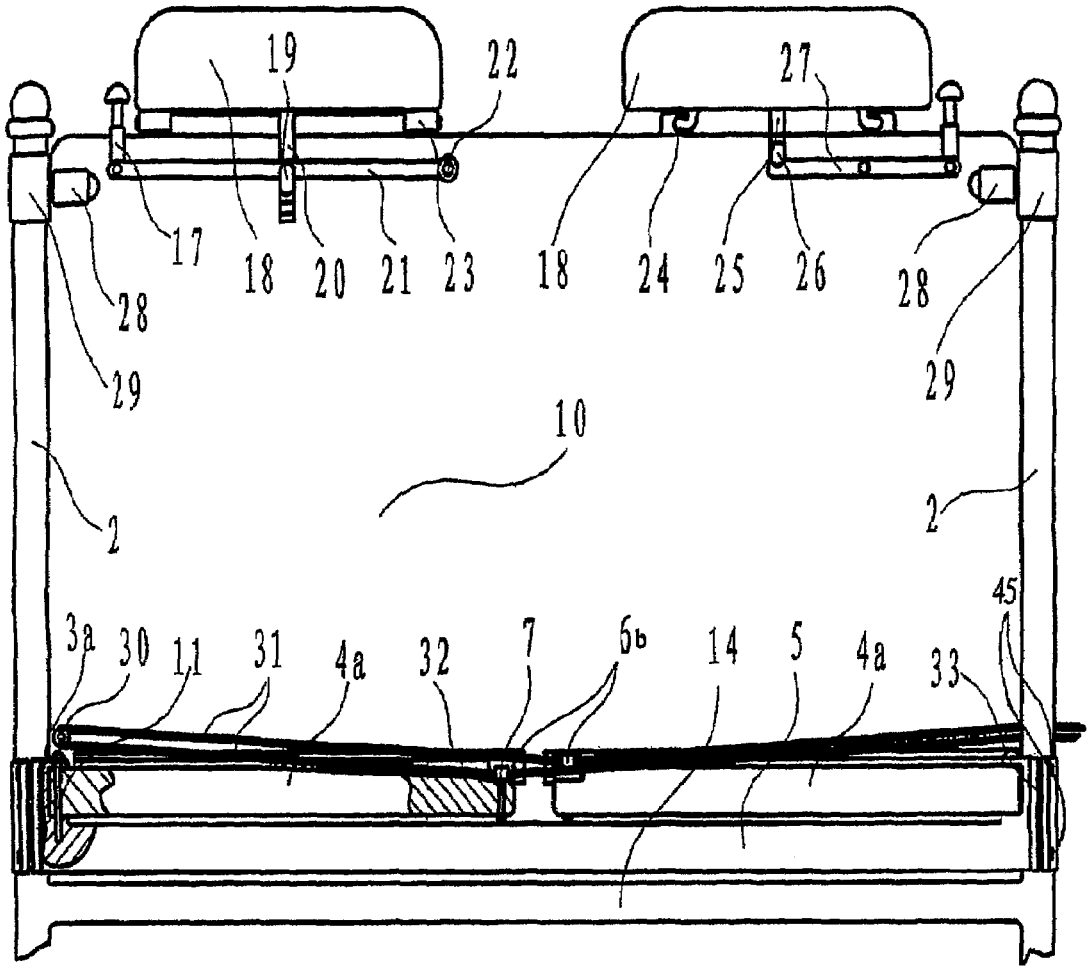
FIG. 2 illustrates a back view of a sitting and sleeping furniture of the present invention, where the parallel mechanism is a pair of roundabout pulling rope controlled left and right horizontal mono supporting arms; the synchronous lifting mechanism is a guide sleeve dynamically engaged with the outer diameter of the back column; two kinds of pillow support adjusting apparatus and a distance adjusting apparatus to adjust the distance between the bottom of the back and the sitting and sleeping platform are also illustrated.

As the sitting and sleeping furniture shown in FIG. 1, the parallel mechanism can be replaced by other parallel mechanisms in different structures described as below: (1) as shown in FIG. 2, it can be a roundabout pulling rope controller serving to control the two horizontal mono supporting arms 4*a*, wherein one end of each horizontal mono supporting arm 4*a* at each side of the back column cross frame 5 is engaged with the left and right vertical hinges 3*a* at the lower side of the back framework, the top end of the rotating shaft 7 at the other end of each supporting arm 4*a* is set respectively with a left and a right guide sleeve 6*b* engaged in the cross guide column 32 below the back 10, said left and right guide sleeves 6*b* are tied to the roundabout pulling rope controller extended from each pulley 30 below the back 10. The pulling rope can be a cord, a wirerope, or a chain. The cyclic movement of the pulling rope controller 31 drives the left and right guide sleeves 6*b* to move inward or outward so as to pull the bottom of the back to be straight parallel. The motion of the pulling rope controller 31 can be driven manually by a conventional winch or chain wheel connected with a handle 12 or a disc 15, or electrically by a motor.

Figure 3:
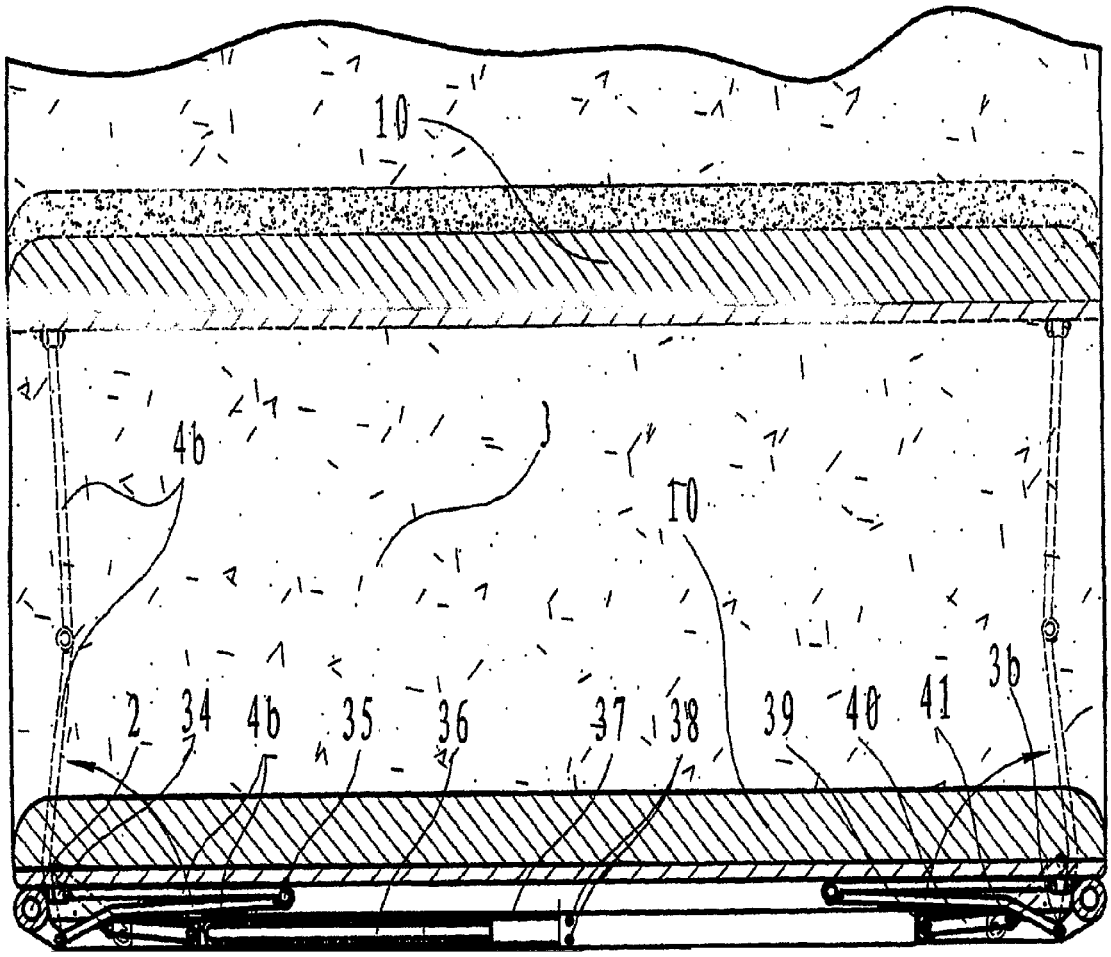
FIG. 3 illustrates a top view (partial section) of a sitting and sleeping furniture, where the parallel mechanism is a pair of two-way hydraulic or pneumatic cylinder controlled left and right horizontal hinge folding supporting arms, the dash line diagram and the arrows illustrate the operation status of the supporting arms.
Figure 8:
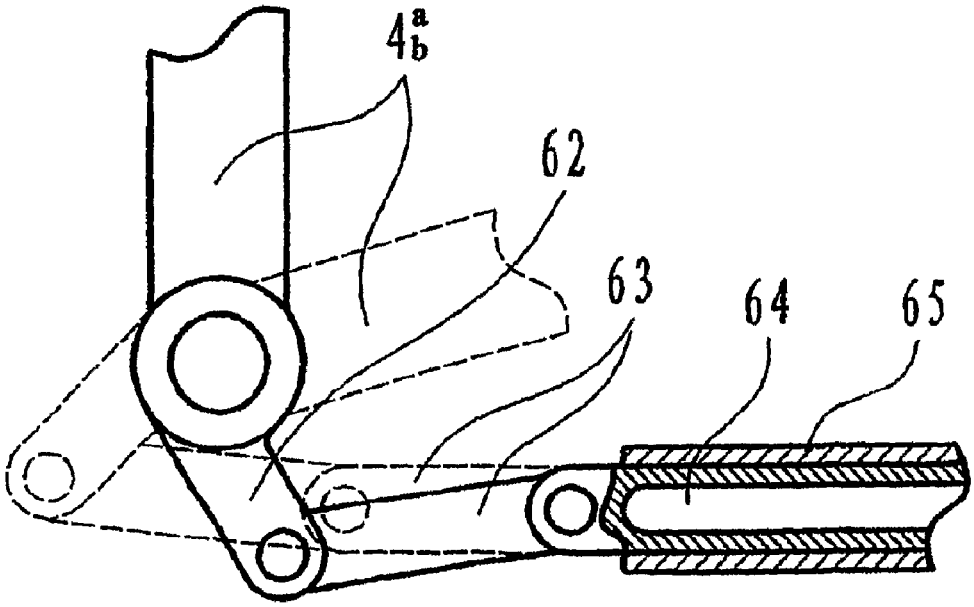
FIG. 8 is a partial structural view of a one-way hydraulic or pneumatic cylinder controller of the present invention.

(2) In combination of FIG. 2 with FIG. 3, the parallel mechanism can be a hydraulic or pneumatic cylinder controller serving to control the two horizontal mono supporting arms 4*a*, wherein one end of each horizontal mono supporting arm 4*a* at each side of the back column cross frame 5 is engaged with the left and right hinges 3*a* at the lower side of the back framework, the left and right guide sleeves 6*b* at the top end of the rotating shaft 7 at the other end of each supporting arm 4*a* are engaged with the cross guide column 32 below the back 10 (as shown in FIG. 2). The left and right cylinder column 36 ends 39 of the horizontal two-way hydraulic or pneumatic cylinder 37 controller set on the back cross frame 5 are hinged with the left and right lead screws 40, respectively, the other end of the lead screw 40 is engaged with the hinge 41 at the upper portion of the joint position of the supporting arm 4*a* and the hinge 3*a* (as shown in FIG. 3) or is engaged with the tails 62 of the hinge 3*a* engaged with the supporting arm 4*a* (as shown in FIG. 8). Said two-way hydraulic or pneumatic cylinder 37 controller comprises a two-way valve 38 for injecting and outputting liquid or gas, the injection or output of the liquid or gas compresses or expands the cylinder column 36, and thus transfers to the supporting arm 4*a* via the lead screw 40 so as to drive the bottom of the back 10 to be straight parallel (the broken line in FIG. 3 shows the supporting arm 4*b* is in a status of operation). The injection or output of the liquid or gas can be realized by a conventional manual pump or a liquid and gas free flow valve, which is opened to start the flow to move the back 10 to the required inclination and is closed to stop the flow, or by an electrically driven liquid and gas pressure pump.

Figure 4:
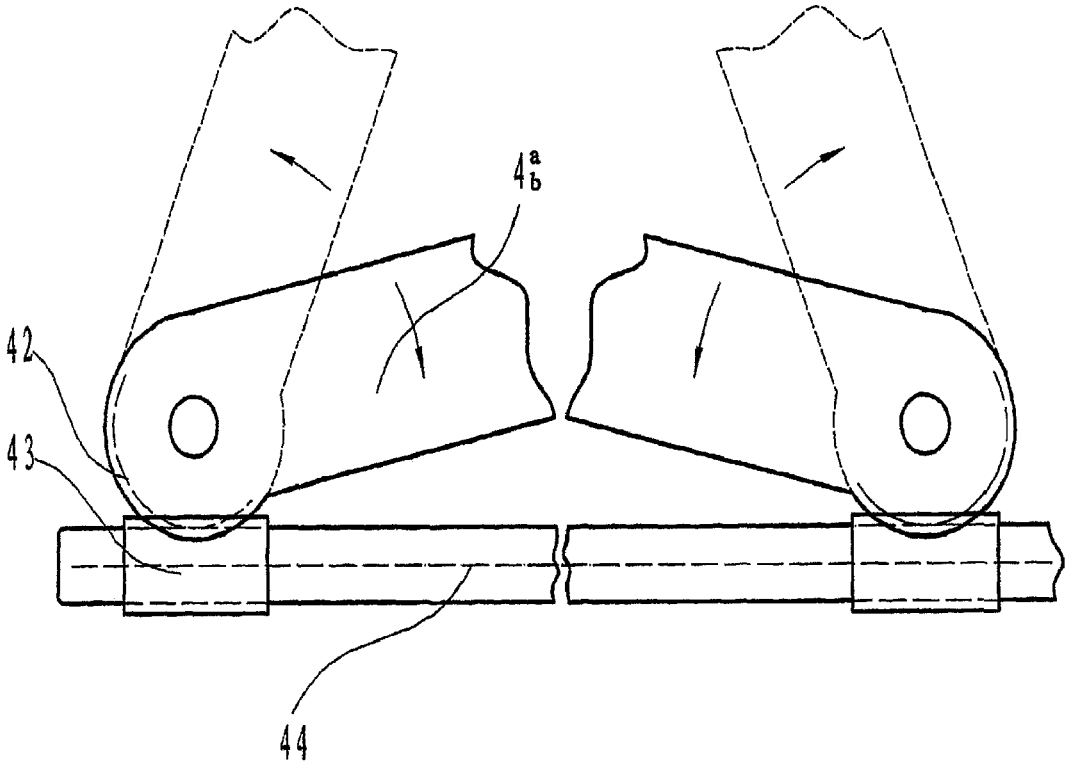
FIG. 4 illustrates a top view of a partial structure of a sitting and sleeping furniture of the present invention, where the parallel mechanism is a pair of left and right thread worm controller, the dash line diagram and the arrows illustrate the operation status of the supporting arms.

(3) In combination of FIG. 2 with FIG. 4, the parallel mechanism can be a worm controller serving to control the two horizontal mono supporting arms 4*a*, wherein one end of each horizontal mono supporting arm 4*a* at each side of the back column cross frame 5 is engaged with the left and right hinges 3*a* at the lower side of the back framework, the left and right guide sleeves 6*b* at the top end of the rotating shaft 7 at the other end of each supporting arm 4*a* are engaged with the cross guide column 32 below the back 10 (as shown in FIG. 2), a left-handed and a right-handed worm wheels 42 are set respectively located outside of the spindle for the hinge 3*a* at each side of the back framework and engaged with said supporting arm 4*a*, and are engaged with the left and right thread worm 43 controllers at each side of the worm shaft 44 on the back column cross frame 5 (as shown in FIG. 4); said worm controller is configured in such a way that the bearing bracket is set at the two ends of the back column cross frame 5, the worm shaft 44 is then installed on the bearing bracket, the worm controller can be driven manually by a disc 15 or handle 12 set at the shaft end, or can be driven electrically by a motor. By only rotating clockwise the worm shaft 44, the worm wheel 42 supporting arm can be driven via the worm 43 (as shown by the dash line diagram and arrow in FIG. 4).

Figure 7:
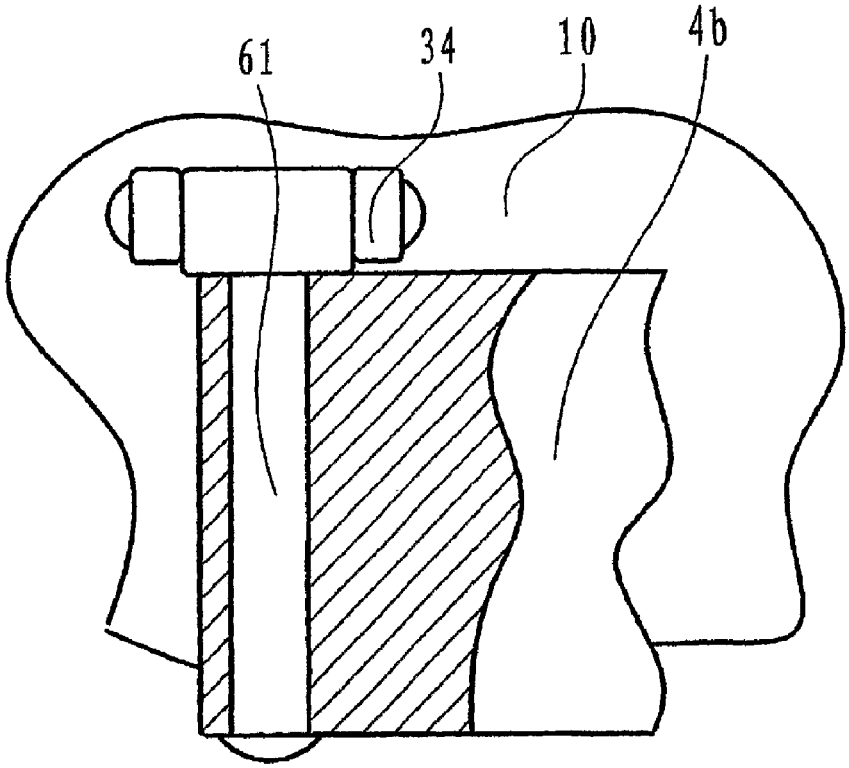
FIG. 7 is a partial structural view of one end of the horizontal hinge folding supporting arm connected with the back of a sitting and sleeping furniture of the present invention.

(4) As shown in FIG. 3, the parallel mechanism can be a hydraulic or pneumatic cylinder controller serving to control the two horizontal hinge folding supporting arms 4*b*, wherein one end of each horizontal hinge 35 folding supporting arm 4*b* at each side of the back column cross frame 5 is engaged with the left and right hinges 3*b* at the lower side of the back framework; the top end of the rotating shaft 61 at the other end of each supporting arm 4*b* (said supporting arm is foldable, a horizontal hinge 35 is set in the middle) is connected with the back hinge 34 (as shown in FIG. 7). The left and right cylinder column 36 ends 39 of the horizontal two-way hydraulic or pneumatic cylinder 37 controller set on the back cross frame 5 are hinged with the left and right lead screws 40, respectively, the other end of the lead screw 40 is engaged with the hinge 41 at the upper portion of the joint position of the supporting arm 4*b* and the hinge 3*b* (as shown in FIG. 3) or is engaged with the tails 62 of the hinge 3*b* engaged with the supporting arm 4*b* (as shown in FIG. 8). The operation principle is the same as described in (2).

(5) In combination of FIG. 3 with FIG. 4, the parallel mechanism can be a worm controller serving to control the two horizontal hinge folding supporting arm 4*b*, wherein one end of each horizontal hinge 35 folding supporting arm 4*b* at each side of the back column cross frame 5 is engaged with the left and right hinges 3*b* at the lower side of the back framework (as shown in FIG. 3); the top end of the rotating shaft 61 at the other end of each supporting arm 4*b* is connected with the back hinge 34 (as shown in FIG. 7). A left-handed and a right-handed worm wheel 42 are set located outside of the spindle for the hinge 3*b* at each side of the back framework and is engaged with said supporting arm, and are engaged respectively with the left and right thread worm 43 controller at each side of the worm shaft 44 on the back column cross frame 5 (as shown in FIG. 4). The operation principle is the same as described in (3).

(6) (7) the parallel mechanism can be a lead screw controller serving to control a single horizontal supporting arm 4*a*, or a roundabout pulling rope controller serving to control a single horizontal mono supporting arm 4*a*, wherein one end of the horizontal mono supporting arm 4*a* is engaged with the vertical hinge 3' at the middle of the back column cross frame 5, the lead screw nut 6*a* at the top end of the rotating shaft 7 at the other end of the horizontal single mono supporting arm 4*a* is engaged with the lead screw controller below the back 10; optionally, one end of the horizontal mono supporting arm 4*a* is engaged with the vertical hinge 3', the guide sleeve 6*b* at the top end of the rotating shaft at the other end is engaged with the guide column below the back 10, said guide sleeve 6*b* is tied to the roundabout pulling rope 31 controller extended from each pulley 30 below the back 10. There is no drawing to indicate the embodiments of the above two parallel mechanisms, however, they can be referred to FIG. 1 and FIG. 2 with the only difference that the supporting arm is engaged in the middle of the back column cross frame 5.

(8) (9) In combination of FIG. 2 or FIG. 3 with one side of FIG. 4, the parallel mechanism can be a worm controller serving to control a single horizontal mono supporting arm 4*a* or a single horizontal hinge folding supporting arm 4*b*. The guide sleeve 6*b* at the top end of the rotating shaft 7 at one end of the horizontal mono supporting arm 4*a* is engaged with the guide column 32 below the back 10, or the top end of the rotating shaft 61 at one end of the horizontal hinge 35 folding supporting arm 4*b* is connected with the back hinge 34, the other end of each of the two supporting arms can be engaged with the vertical hinge 3' at the middle of the back column cross frame 5 (as shown in the left side of FIG. 6), the worm wheel 42 located outside of the spindle for said supporting arm vertical hinge 3' is engaged with the worm 43 controller parallel to the supporting arms 4*a*, 4*b*. There is no drawing for these two embodiments, but they can be referred to half of the FIG. 2 and FIG. 3, and both adopts the one end worm controller in FIG. 4.

Figure 5:
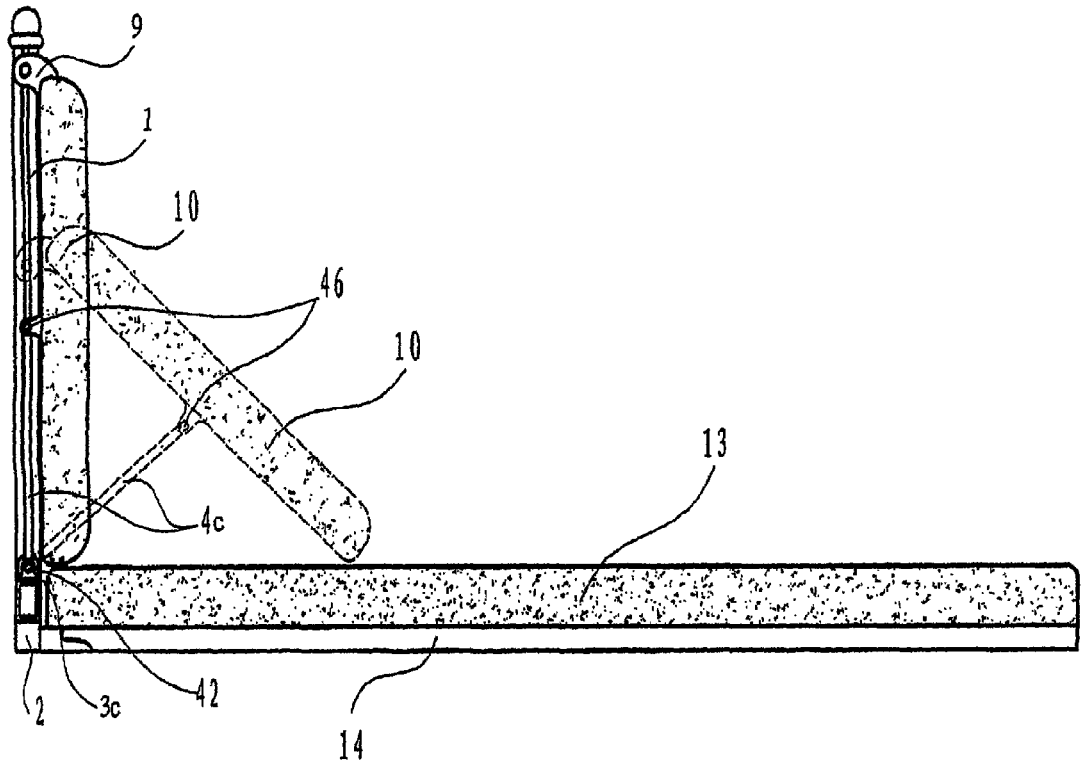
FIG. 5 illustrates a side view (partial section) of a sitting and sleeping furniture without leg of the present invention, where the parallel mechanism is a worm controlled stand supporting arm, the dash line diagram illustrates the operation status of the stand supporting arm.
Figure 6:
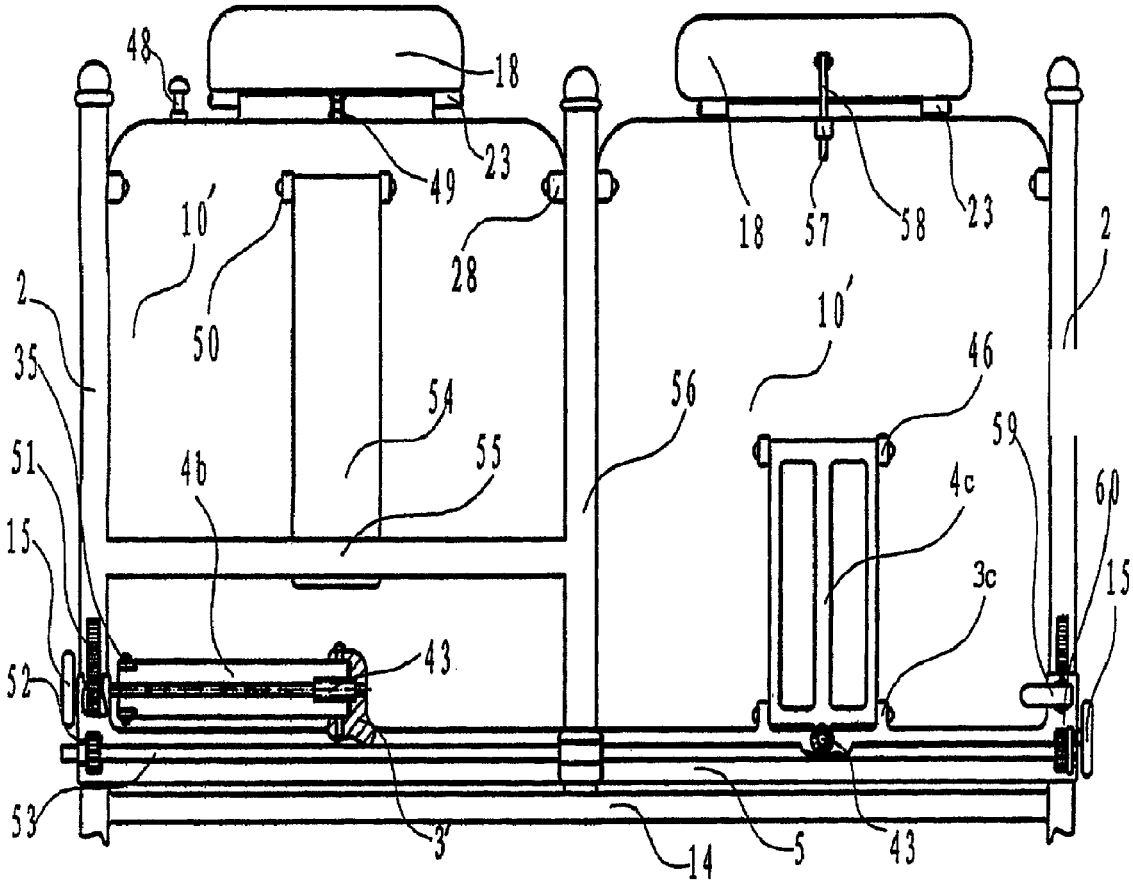
FIG. 6 illustrates a back view of a two paratactic backs of the present invention, where the right side view shows a stand supporting arm; the left side view shows a horizontal hinge folding supporting arm, they are all worm controllers; a pillow support apparatus and a distance adjusting apparatus to adjust distance between the bottom of the back and the sitting and sleeping platform are also showed in FIG. 6.

(10) As shown in FIG. 5 and the right side of FIG. 6, the parallel mechanism can be a worm controller serving to control a stand supporting arm 4*c*, wherein the top end of the stand supporting arm 4*c* is engaged with the hinge 46 at the middle of the backside of the back 10, the bottom end is connected with the hinge 3*c* at the middle of the back column cross frame 5, the worm wheel 42 located outside of the spindle for said cross hinge 3*c* is engaged with the worm 43 controller. Said worm 43 is set in the worm shaft at the bearing bracket on the back column cross frame 5. The rotation of the worm shaft is operated manually by changing the rotation direction via a square gear; the output axial end of the square gear is installed with a disc 15 or a handle 12. The worm 43 can also be driven electrically by a motor directly. The quantity of said stand supporting arm 4*c* at the backside of the back 10 can be at least one.

(11)-(13) In combination of FIG. 2 or the left side of FIG. 6 or the right side of FIG. 6 with FIG. 8, the parallel mechanism can be a hydraulic or pneumatic cylinder controller serving to control a single horizontal mono supporting arm 4*a*, or a single horizontal hinge folding supporting arm 4*b*, or a stand supporting arm 4*c*, wherein the guide sleeve 6*b* at the top end of the rotating shaft 7 at one end of the horizontal mono supporting arm 4*a* is engaged with the guide column 32 below the back 10 (half part of FIG. 2); or the top end of the rotating shaft 61 at one end of the horizontal hinge 35 folding supporting arm 4*b* is connected with the hinge 34 at the middle position below the back (as shown in the left side of FIG. 6, FIG. 7); or the top end of the stand supporting arm 4*c* is connected with the hinge 46 at the middle position at the backside of the back 10 (as shown in the right side of FIG. 6); the other ends of the three supporting arms are connected with the vertical hinges 3', 3', and cross shaft 3*c*, respectively, at the middle of the back column cross frame 5, the end of the cylinder column 64 of the one-way hydraulic or pneumatic cylinder controller 65 is hinged with the connecting rod 63, the other end of said connecting rod 63 is engaged with the upper hinge 41 (as shown in FIG. 3) at the joint position of the supporting arms 4*a*, 4*b*, 4*c* with the hinges 3', 3', 3*c*, respectively, or with the tails 62 (as shown in FIG. 8) extended from the hinges 3', 3', and 3*c*, respectively. The above three embodiments all adopt a one-way hydraulic or pneumatic cylinder controller serving to control the horizontal and stand supporting arms.

Figure 9:
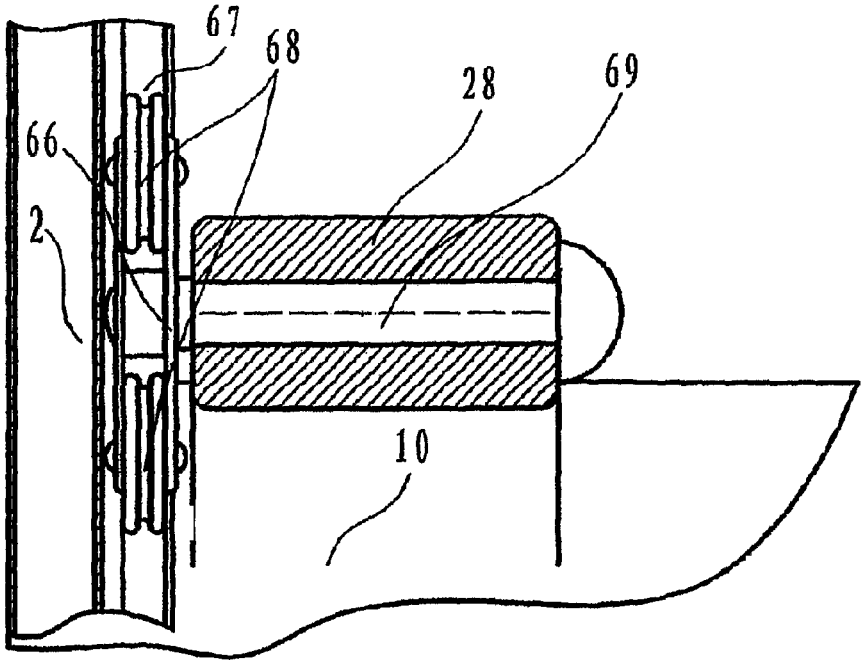
Figure 10:
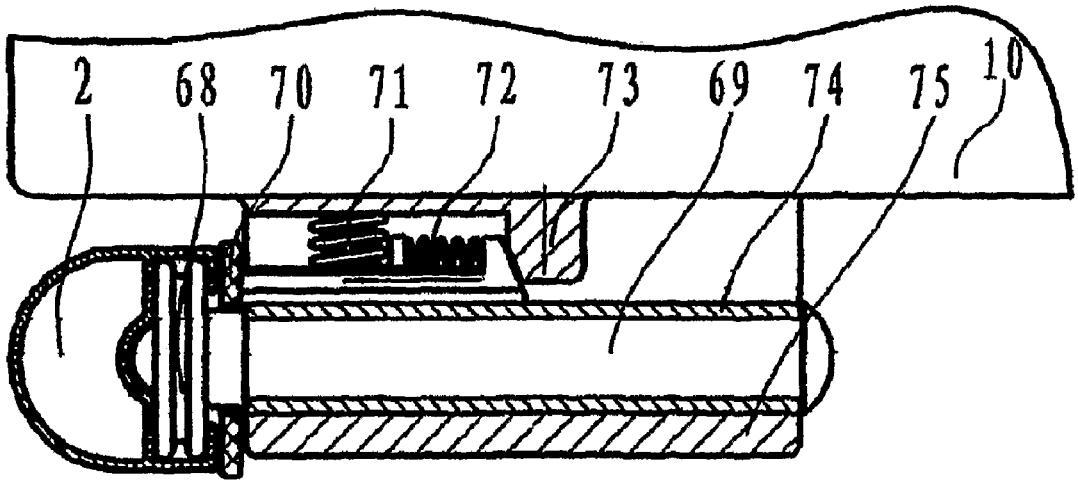
Figure 11:
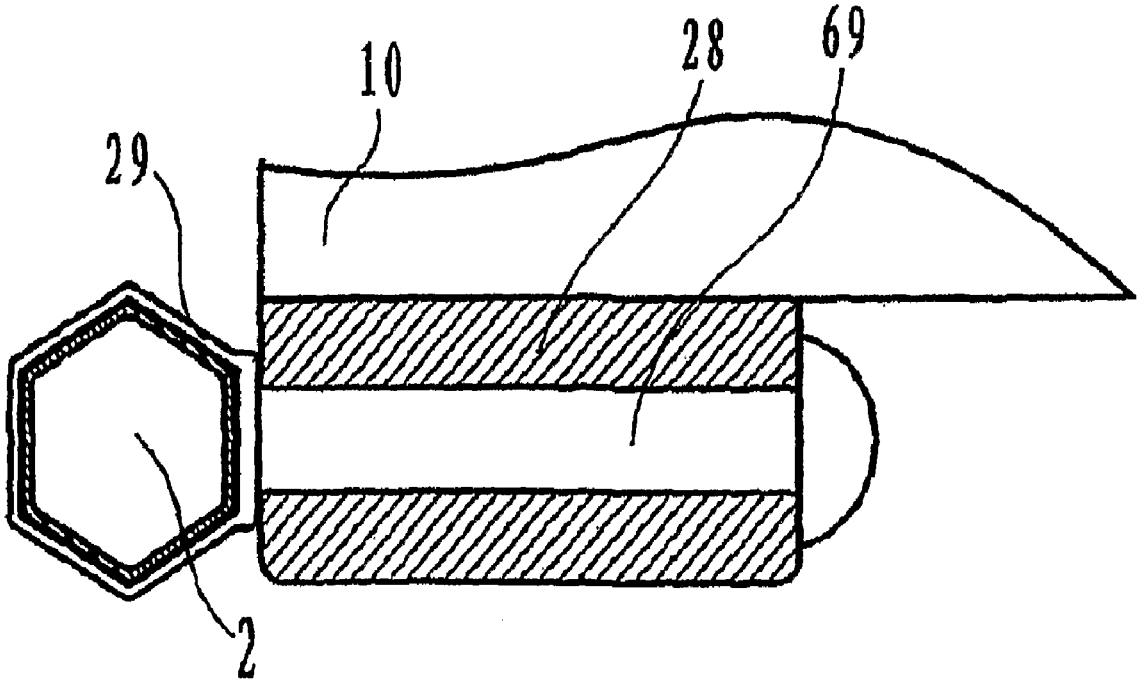
Figure 12:
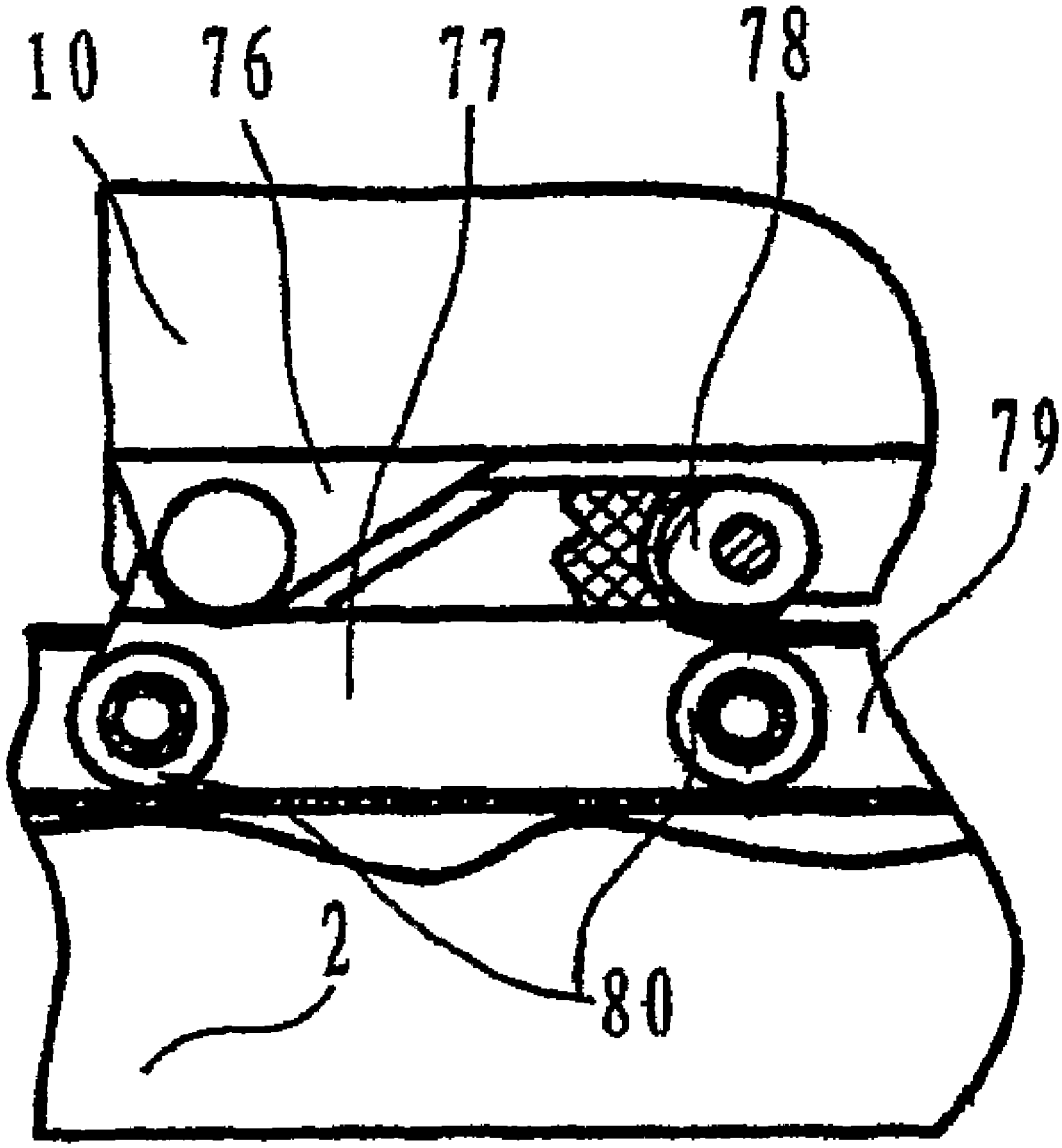
Figure 13:
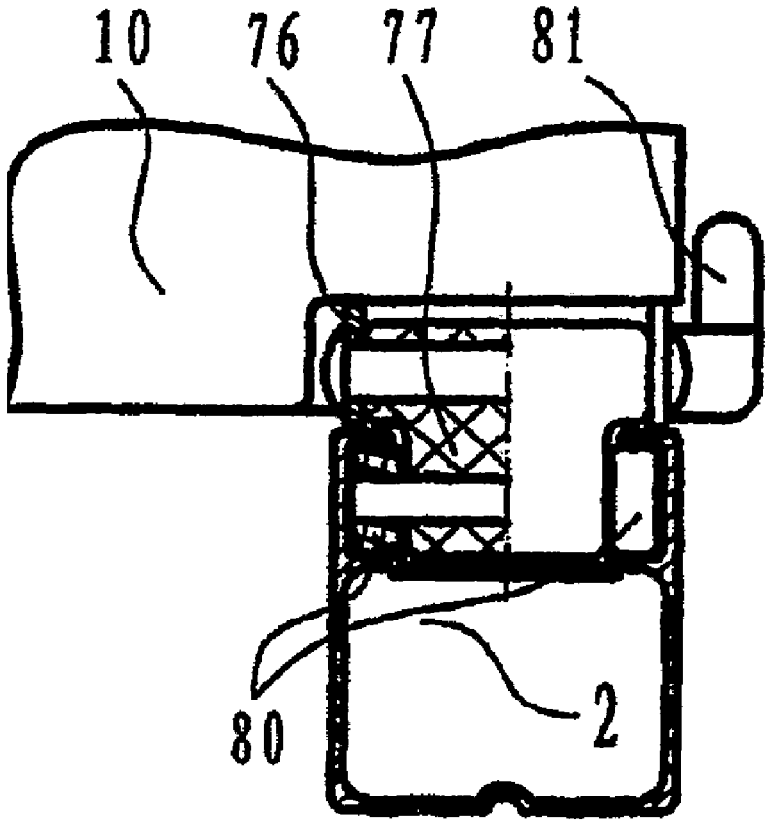
Figure 14:
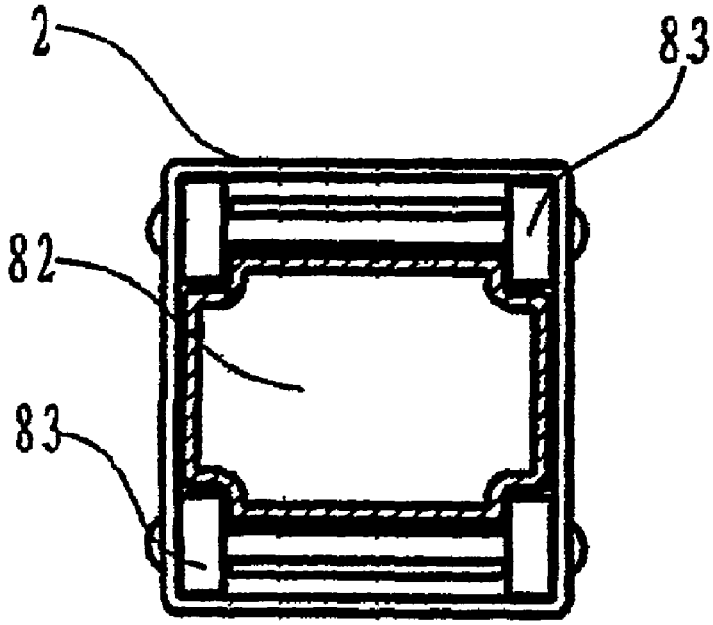
Figure 15:
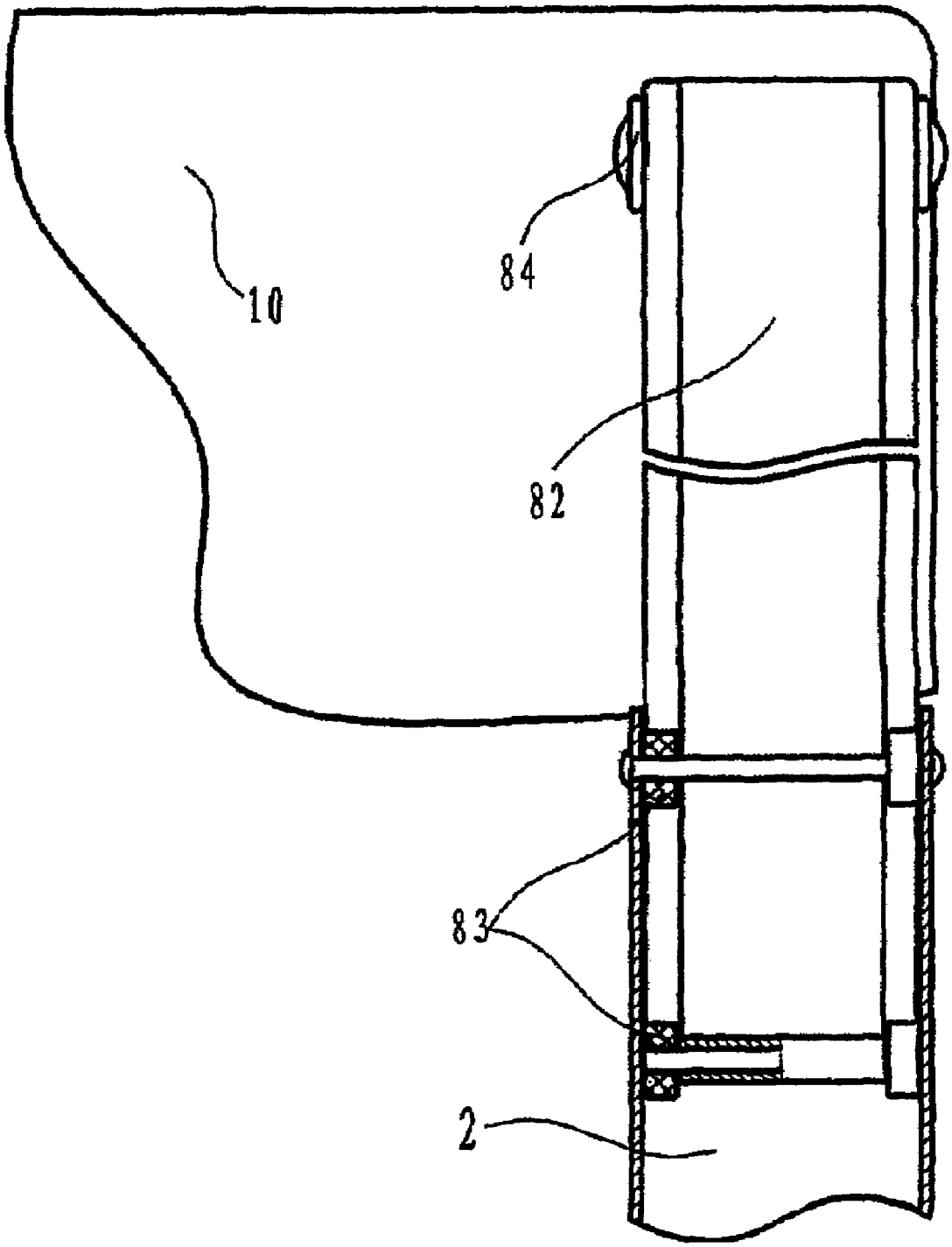

Obviously, the above several embodiments of the parallel mechanism can be replaced with each other. Similarly, the synchronous lifting mechanism at the upper side of the back 10 shown in FIG. 1 to keep the top of the back to be parallel with the bottom of the back can also be replaced with each other. As shown in FIG. 9, one end of the hinge shaft 69 of the hinge 28 at the upper side of the back 10 is connected with a pulley yoke 66, the pulley 68 at each end of said pulley yoke 66 runs in the guide way 67 at the inner side of each back column 2. Optionally, as shown in FIG. 10, the square shell hinge 74 at each upper side of the back 10 is engaged dynamically in the inner cavity of the hinge shell 75, the pulley 68 at the end of hinge shaft 69 runs in the guide way 67 at the inner side of each back column 2. A back compression spring 71 and an inclination push block 73 engaged with an inclination back column lock 70 are set between said square shell hinge 74 and the back 10, a back column lock return compression spring 72 is set in the back column lock 70. Besides the synchronous lifting function, said synchronous lifting mechanism can also realize the function to lock the upper end of the back 10. When the back 10 is compressed, the inclination push block 73 pushes the inclination back column lock 70 to the back column 2, so as to fix the upper end of the back 10 to the proper adjusted position. When the back 10 is released free from compression, the back compression spring 71 and at the same time the inclination push block 73 return to their normal position, the back column lock 70 returns to its normal position under the function of the back column lock return compression spring 72. This embodiment is especially suitable for a horizontal supporting arm parallel mechanism. As shown in FIG. 11, the hinge shaft 69 of the hinge 28 at each upper side of the back 10 is connected with the guide sleeve 29 dynamically engaged with the outer diameter of the back column 2, compared with that in FIG. 2, the back column of this structure is in a shape of hexagon. The back column can be in a shape of circle, hexagon, or square. The synchronous lifting mechanism can also be configured in such a way as illustrated in FIGS. 12-13, wherein each upper end of the back 10 is engaged with the hinge 76 of the pulley yoke 77, the parallel pulleys 80 on the pulley yoke 77 run in the guide way 79 corresponding to the backside of the back 10. A cam 78 lock spanner 81 is set on said pulley yoke 77 to lock the guide way 79, when the inclination of the back 10 is adjusted to a comfortable position, the pulley yoke can be fixed on this position by pressing the cam lock spanner 81, which is mainly used for the back 10 with a horizontal supporting arm parallel mechanism. Optionally, the synchronous lifting mechanism can also be as that illustrated in FIGS. 14-15, wherein the upper end at each side of the back 10 is engaged with the hinge 84 of the back guide column 82, the guide column 82 is inserted dynamically into the inner cavity of the back column 2, an shaft operated pulley 83 is set below said guide column 82 and above said back column 2. With this embodiment, after the upper end of the back 10 moves downward, the back column will not be exposed to influence appearance.

The above embodiments provide the technical solutions for the parallel mechanism and the synchronous lifting mechanism. Between the parallel mechanism and the synchronous lifting mechanism, they can be replaced with each other in a specific embodiment, and the two mechanisms can be combined randomly to form a lifting mechanism matching with the parallel mechanism to fulfill the straight parallel motion of the bottom of the back 10 on the sitting and sleeping platform, while the supporting arm is controlled by the controller in a parallel mechanism. The worm controller and the hydraulic or pneumatic cylinder controller are interchangeable, and these two controllers can be used to replace the roundabout pulling rope controller. The power of the controller is from a power source, wherein the lead screw 8, the pulling rope 31, and the worm 43 are driven manually by a disc 15 and a handle 12, or driven electrically by a motor; said two-way or one-way hydraulic or pneumatic cylinder 37, 65 are driven by manual hydraulic or pneumatic pump, or driven by electrical hydraulic or pneumatic pump. They can be operated by a reversing switch, a reversing button, or a remote controller.

Figure 16:
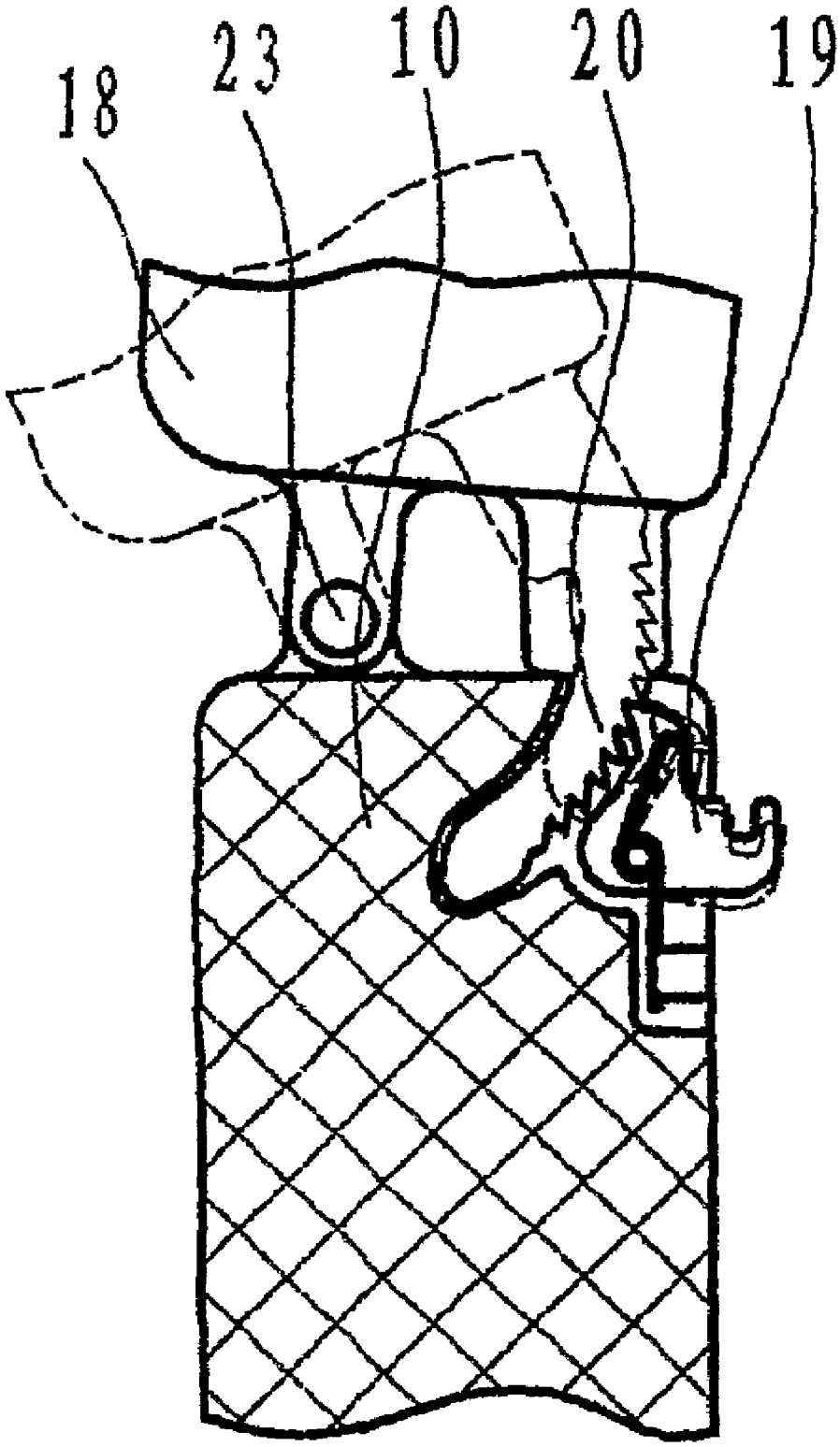
FIGS. 16-18 are partial structural views of three kinds of pillow support adjusting apparatus of the present invention.
Figure 17:
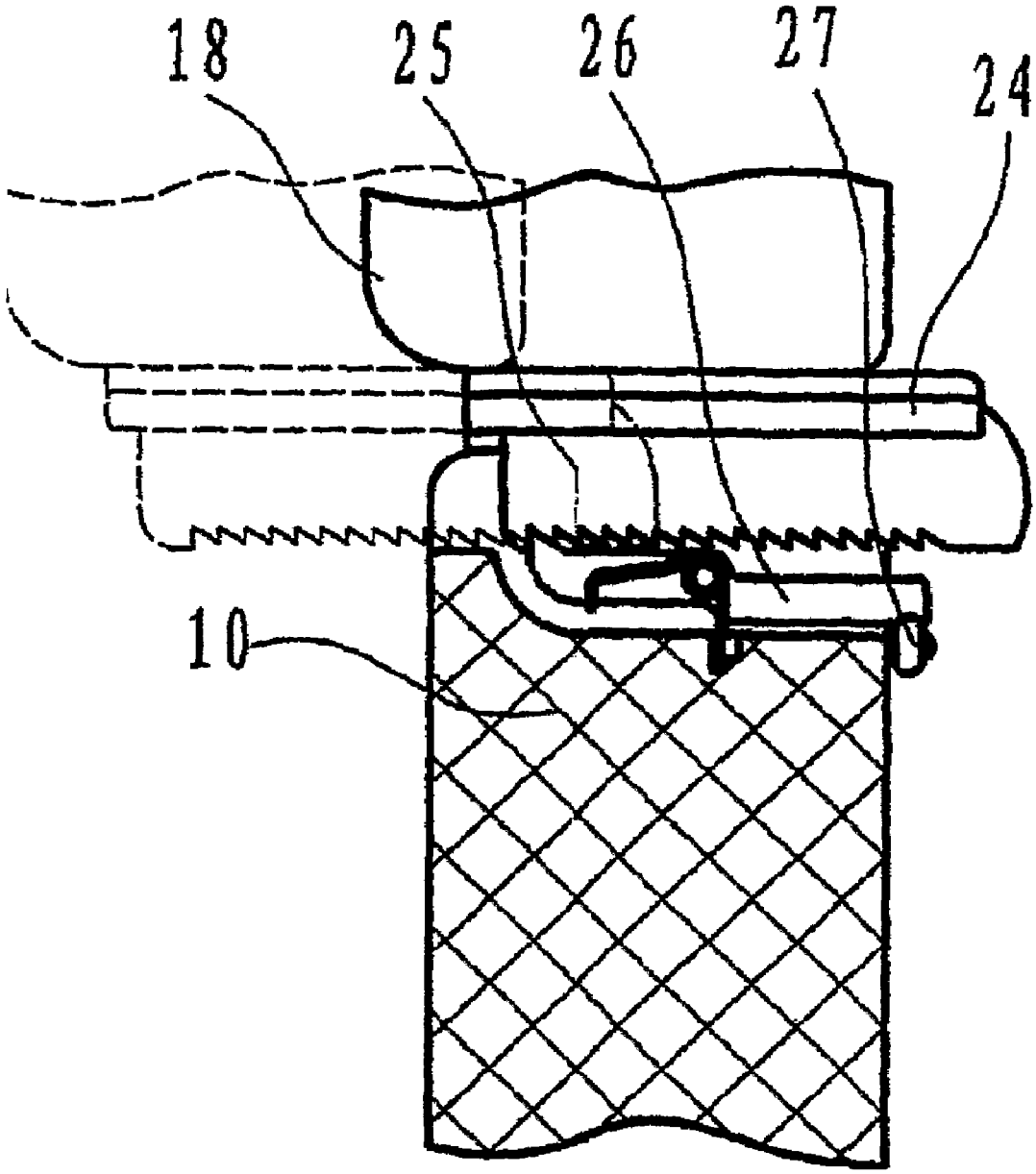
Figure 18:
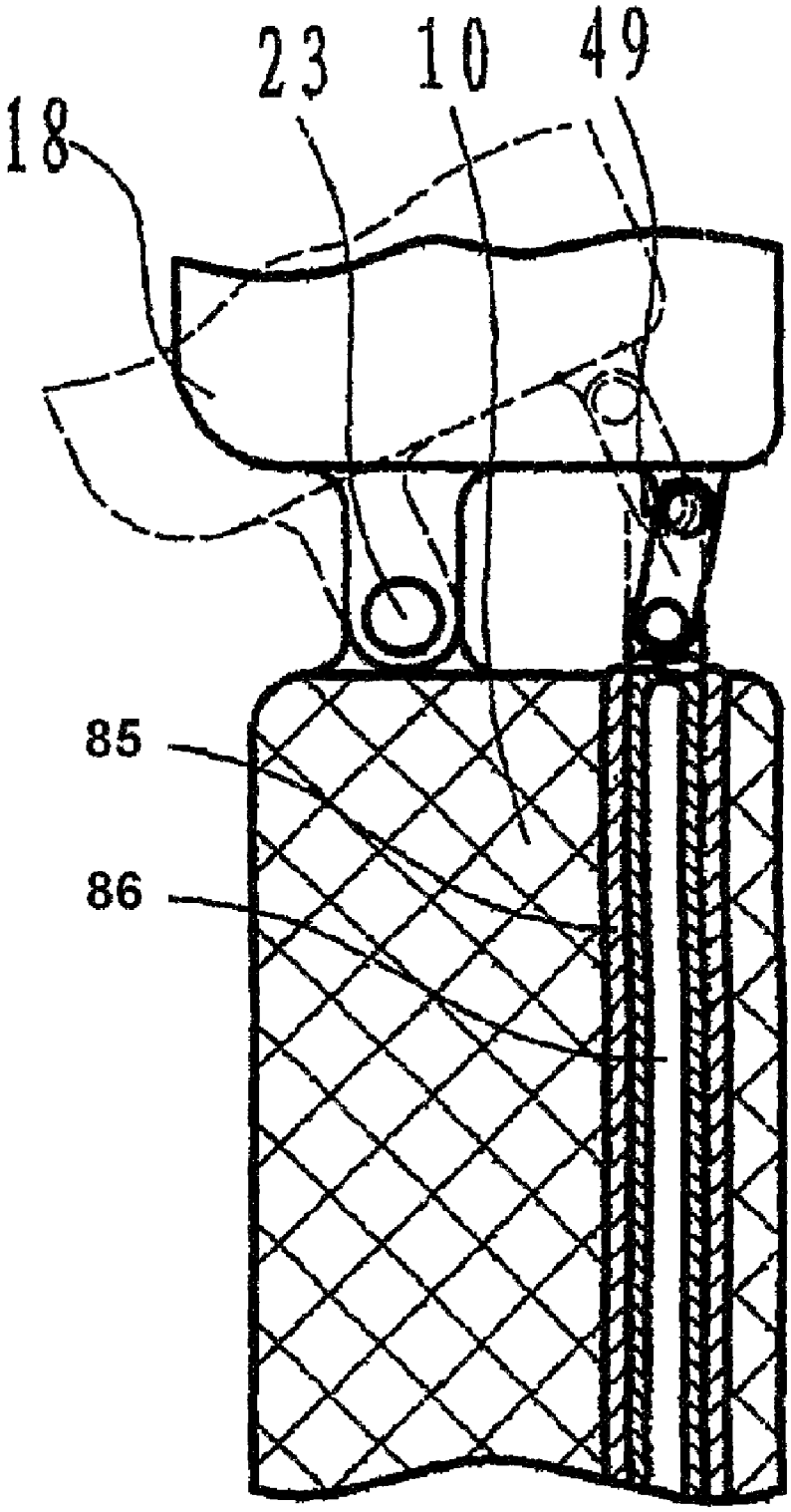

To provide more comfort for the user, a pillow support adjusting apparatus is set on the upper end of said back 10. As shown in FIG. 16 and the left side of FIG. 2, the bottom end of the pillow support 18 is engaged with the hinge 23 at the front of each upper side of the back 10, a R-shaped support tooth segment 20 rotating with the hinge 23 is set below the backside of the pillow support 18, said R-shaped support tooth segment 20 is set with an support top segment 19 for housing the spring. When the pillow support inclines forward, the support top block 19 pushes automatically the R-shaped support tooth segment 20 under the function of the spring. Pressing the tail of the support top block 19, the support top block 19 moves away from the support tooth block 20, the pillow support 18 returns to its normal position under self-weight, the spring can also be set to return. As shown in FIG. 2, for easy operation, a cross rod 21 is set to engage with the hinge 22. Pressing the button 17, the cross rod 21 opens the support top block so as to adjust the pillow support 18. As shown in FIG. 17 and the right side of FIG. 2, the bottom end of the pillow support 18 is matched with the drawer type guide way 24 at the top of the back 10, a parallel support tooth block 25 is set between the two-path guide ways 24, said parallel support tooth block 25 is set with a hinged support top block 26 for housing the spring (FIG. 17). When the pillow support 18 is pushed to move forward, the spring support top block 26 pushes automatically the parallel support tooth segment 25 under the function of spring. Pressing the tail of the support top block 26, the support top block 26 moves away from the support tooth block 20, the pillow support 18 returns to its normal position under self-weight, the spring can also be set to return. In the pillow support adjusting apparatus as shown in the right side of FIG. 2, for easy operation, a cross rod 27 is set to engage with the hinge 22, pressing the button 17, the top of the cross rod moves away from the support tooth block 26, so that the pillow support can be adjusted. Optionally, as shown in FIG. 18 and the left side of FIG. 6, the bottom end of the pillow support 18 is engaged with the hinge 23 at the front of each upper side of the back 10, the bottom end at the backside of the pillow support 18 is engaged with the connecting rod 49, the other end of said connecting rod 49 is engaged with the cylinder column end 86 of an one-way hydraulic or pneumatic cylinder 85. A hydraulic or pneumatic manual pump 48 is set on the top of the left side of the back 10 in FIG. 6. The right side of the FIG. 6 illustrates a conventional technology for a straight support tooth block 58 and a support top shell 57. The diagram in dash lines in FIGS. 16-18 illustrates an operation status of a pillow support 18. Said pillow support 18 can be adjusted manually or electrically.

To satisfy the needs to adjust the thickness of the mattress according to the weather change, an adjusting apparatus to adjust the distance between the bottom of the back 10 and the sitting and sleeping platform 13 is set at the two ends of said back column cross frame 5. As an example 1 shown in FIG. 2, the distance adjusting apparatus comprises an open cover 33 fit engaged with the outer diameter of the back column 2 is set at the two ends of the back column cross frame 5, a plurality of fasteners 45 is set at the two sides of the opening of the cover 33. The distance between the bottom of the back 10 and the sitting and sleeping platform 13 is realized by releasing the fasteners 45 to adjust the position of the back cross frame 5 on the back column 2 and then tightening the fasteners to fix.

As an example 2 shown in FIG. 6, the distance adjusting apparatus is configured in such a way that the sleeve 60 at each side of the back column cross frame 5 is engaged dynamically with the outer diameter of the back column 2, said sleeve 60 is opened with a gear cavity to engage with the synchronous gear wheel 52 connected by a rotating shaft 53, said synchronous gear wheel 52 can be geared with the spur rack 51 set on the back column 2, said sleeve 60 is also installed with a positioning cam spanner 59 to adjust the distance between the bottom of the back 10 and the sitting and sleeping platform 13. By raising the cam spanner 59, the rotating shaft 53 drives the synchronous gear wheel 52 to move upward and downward in the spur rack 51 so as to drive the back column cross frame to lift to the right distance, then pressing the cam spanner 59 to lock.

The various embodiments of the above mentioned pillow support adjusting apparatus and the distance adjusting apparatus between the bottom of the back 10 and the sitting and sleeping platform 13 are interchangeable and can be combined for application.

Besides, embodiment 1 illustrates a bed with an arbitrarily adjustable inclination, the size of the sitting and sleeping platform can be suitable for a sofa, a couch, or a seat. As shown in FIG. 5, it also can be a bed without leg under the sitting and sleeping platform skeleton, which is popular in Japan and Korea. The parallel mechanism in FIG. 5 is a worm controller controlling a stand supporting arm, and its lifting mechanism is a guide column 9 combining with a guide way 1. The dash line illustrates the operation status of the back and the supporting arm, it is for sure that said bed could be installed with other parallel and lifting mechanisms and other apparatus.

Embodiment 2

The basic structure of embodiment 2 is the same as that of embodiment 1, which also has parallel mechanism and lifting mechanism, and can be installed with pillow support adjusting apparatus and distance adjusting apparatus for adjusting the distance between the bottom of the back and the sitting and sleeping platform 13. The difference is that a back column 56 having two-path guide ways are added between the two back columns 2 (as shown in FIG. 6). The bottom of the back column 56 is connected with the back column cross frame 5. Two paratactic backs 10' are set between the back column 56 and the two back columns 2. A separate parallel mechanism or the same parallel mechanism can be set for the two backs 10'. As shown in FIG. 6, the parallel mechanism at the right side is configured in such a way that the worm controller is set to control the stand mono supporting arm, while that at the left side is configured in such a way that the worm controller is set to control a single horizontal hinge 35 folding supporting arm (the specific structure is described as above). The above pillow support apparatus is set as the structure showed in example 3, wherein a manual hydraulic or pneumatic pump button 48 is installed. Moreover, a back operation stabilizing apparatus is set in the middle of the pillow support, which comprises a back guide plate 54 and a back guide sleeve 55, wherein one end of the back guide plate 54 is connected to the backside of the back 10' via the hinge 50, the other end is inserted into the back guide sleeve 55. Optionally, the two sides can share the same parallel mechanism. The purpose of the present embodiment is mainly for increasing the product flexibility, so that the user at the right side and the left side can adjust the inclination of the back independently according to their own demand. Certainly, a sitting and sleeping furniture with more than two back columns having two-path guide ways can be set according to the present invention, at this moment the quantity of the backs should be at least 3, which can be in the same or different sizes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A sitting and sleeping furniture, comprising:

a back (10) having a top and a bottom;

a sitting and sleeping platform (13);

a plurality of back columns (2);

a back column cross frame (5);

a plurality of sitting and sleeping platform frames (14);

a parallel mechanism for moving said bottom of said back (10) toward and away from said back columns (2), said parallel mechanism comprising a plurality of supporting arms and a supporting arm controller; and a synchronous lifting mechanism for moving said top of said back (10) up and down alongside said back columns (2), said synchronous lifting mechanism connects said top of said back (10) to said back columns (2);

wherein said back columns (2) are connected with said back column cross frame (5) whereby forming a back column framework;

said sitting and sleeping platform frames (14) are connected with said back column framework whereby forming a sitting and sleeping platform skeleton;

said parallel mechanism is set below said back and above said sitting and sleeping platform (13);

said synchronous lifting mechanism is adapted to cooperate with said parallel mechanism to keep said top of said back at a constant distance with respect to said bottom of said back; and said synchronous lifting mechanism is disposed at said top of said back (10).

2. The furniture of claim 1, wherein said supporting arm is a horizontal mono supporting arm (4*a*), a horizontal hinge folding supporting arm (4*b*), or a stand supporting arm (4*c*).

3. The furniture of claim 1, wherein said supporting art controller is a lead screw-type controller, a pull rope-type controller, a hydraulic or pneumatic-type cylinder controller, or a worm-type controller.

4. The furniture of claim 3, wherein (i) said horizontal mono supporting arm (4*a*) is hinged with said back column framework; a rotating shaft (7) connected to said horizontal mono supporting arm (7) is connected to a screw nut (6*a*), said lead screw nut (6*a*) being engaged with a lead screw (8) controller connected to said back (10);

(ii) said horizontal mono supporting arm (4*a*) is connected to hinges (3*a*), said hinges (3*a*) being connected to said back column framework; guide sleeves (6*b*) connected to a rotating shaft (7) are engaged with cross frames (32) connected to said back (10); said guide sleeves (6*b*) are tied to said pull rope-type controller;

(iii) said horizontal mono supporting arm (4*a*) is connected to hinges (3*a*), said hinges being connected to said back column framework; guide sleeves (6*b*) connected to a rotating shaft (7) are engaged with cross guide columns (32) connected to said back (10); hydraulic or pneumatic cylinder controller (37) disposed on said back cross frame (5) are hinged with connecting rods (40), said connecting rods (40) being engaged with hinges (41) connected to said horizontal mono supporting arm (4*a*);

(iv) said horizontal mono supporting arm (4*a*) is hinged with hinges (3*a*); guide sleeves (6*b*) connected to said rotating shaft (7) are engaged with a cross guide column (32); worm wheels (42) are located outside of said hinges (3*a*) engaged with said horizontal mono supporting arm (4*a*) and are engaged with lead screw controllers (43);

(v) said horizontal hinge folding supporting arm (4*b*) is hinged with hinges (3*b*); a rotating shaft (61) connected to said horizontal hinge folding supporting arm (4*b*) is connected with hinges (34); hydraulic or pneumatic cylinder controller disposed on said back cross frame (5) are hinged with connecting rods (40); said connecting rods (40) are engaged with hinges (41) connected to said horizontal hinge folding supporting arm (4*b*) and said hinges (3*b*);

(vi) said horizontal hinge folding supporting arm (4*b*) is engaged with hinges (3*b*) connected to said back column framework; a rotating shaft (61) is connected with a back hinge (34); and worm wheels (42) are connected to said hinges (3*b*) and are engaged with said supporting arm (4*b*), and are further engaged with said worm-type controller;

(vii) said horizontal mono supporting arm (4*a*) is hinged with a vertical hinge (3'); a lead screw nut (6*a*) connected to a rotating shaft (7) is engaged with said lead screw-type controller;

(viii) said horizontal mono supporting arm (5) is hinged with a vertical hinge (3'); a guide sleeve (6*b*) connected to a rotating shaft (7) at is engaged with a guide column (32); and said guide sleeve (6*b*) is tied to said roundabout pull rope-type controller;

(ix) a guide sleeve (6*b*) connected to a rotating shaft (7) is engaged with a guide column (32), said supporting arm is engaged with a vertical hinge (3') ; a worm wheel (42) is engaged with said worm (43) controller being parallel to said supporting arm (4*a*,4*b*); or (x) a guide sleeve (6*b*) connected to a rotating shaft (7) is engaged with a guide column (32); said supporting arm is engaged with hinges (3', 3', 3*c*); hydraulic or pneumatic cylinder controller is hinged with one end of a connecting rod (63), the other end of said connecting rod (63) is engaged with a hinge (41) of said supporting arms (4*a*, 4*b*, 4*c*) and the hinges (3', 3', 3*c*).

5. The furniture of claim 1, wherein said lead screw controller, pull rope-type controller, or worm-type controller is driven manually or by a motor; and said hydraulic or pneumatic cylinder controller is driven manually or by a motor.

6. A sitting and sleeping furniture, comprising:

a back (10) having a top and a bottom;

a sitting and sleeping platform (13);

a plurality of back columns (2);

a back column cross frame (5);

a plurality of sitting and sleeping platform frames (14);

a parallel mechanism for moving said bottom of said back (10) toward and away from said back columns (2), said parallel mechanism comprising a plurality of supporting arms and a supporting arm controller; and a synchronous lifting mechanism for moving said top of said back (10) up and down alongside said back columns (2), said synchronous lifting mechanism connects said top of said back (10) to said back columns (2);

wherein said back columns (2) are connected with said back column cross frame (5) whereby forming a back column framework;

said sitting and sleeping platform frames (14) are connected with said back column framework whereby forming a sitting and sleeping platform skeleton;

said parallel mechanism is set below said back and above said sitting and sleeping platform (13);

said synchronous lifting mechanism is adapted to cooperate with said parallel mechanism to keep said top of said back at a constant distance with respect to said bottom of said back;

said synchronous lifting mechanism is disposed at said top of said back (10); and said synchronous lifting mechanism comprises:

(i) a cross T-shape guide column (9); said cross T-shape guide column (9) runs in a guide way (1) along the inner side of said back column (2);

(ii) a hinge shaft (69), a pulley yoke (66), and a plurality of pulleys (68); one end of said hinge shaft (69) being connected to said pulley yoke (66); and said pulleys (68) being disposed at two ends of said pulley yoke (66) running in a guide way (67) along the inner side of said back column (2);

(iii) a square shell hinge (74), a hinge shell (75), a plurality of pulleys (68), a hinge shaft (69), a back compression spring (71), an inclination push block (73), an inclination back column lock (70), and a return compression spring (72); said square shell hinge (74) being dynamically housed in the inner cavity of said hinge shell (75); said pulleys (68) being disposed at two ends of said hinge shaft (69) running in a guide way (67) along the inner side of said back column (2); said back compression spring (71) and said inclination push block (73) being disposed between said square shell hinge (74) and said back (10) and being engaged with said inclination back column lock (70); and said return compression spring (72) being disposed on said back column lock (70);

(iv) a hinge (28) having a hinge shaft (69), and a guide sleeve (29); said hinge shaft (69) being connected with said guide sleeve (29); said guide sleeve (29) being dynamically engaged with the outer diameter of said said back column (2);

(v) a pulley yoke (77) having a hinge (76) and a plurality of parallel pulleys (80); a); and a cam (78) having a cam lock spanner (81); said top of said back (10) being engaged with said hinge (76); said parallel pulleys (80) running in a guide way (79) along said back (10); and said cam lock spanner (81) being set on said pulley yoke (77) whereby being adapted to lock said guide way (79); or (vi) a guide column (82) having a hinge (84), and a shaft operated pulley (83); said hinge (84) being engaged with said top of said back (10); said guide column (82) being movable within an inner cavity of said back column (2); and said shaft operated pulley (83) being set below said guide column (82) and above said back column (2).

7. A sitting and sleeping furniture, comprising:

a back (10) having a top and a bottom;

a sitting and sleeping platform (13);

a plurality of back columns (2);

a back column cross frame (5);

a plurality of sitting and sleeping platform frames (14);

a parallel mechanism for moving said bottom of said back (10) toward and away from said back columns (2), said parallel mechanism comprising a plurality of supporting arms and a supporting arm controller;

a synchronous lifting mechanism for moving said top of said back (10) up and down alongside said back columns (2), said synchronous lifting mechanism connects said top of said back (10) to said back columns (2); and a pillow support (18);

wherein said back columns (2) are connected with said back column cross frame (5) whereby forming a back column framework;

said sitting and sleeping platform frames (14) are connected with said back column framework whereby forming a sitting and sleeping platform skeleton;

said parallel mechanism is set below said back and above said sitting and sleeping platform (13);

said synchronous lifting mechanism is adapted to cooperate with said parallel mechanism to keep said top of said back at a constant distance with respect to said bottom of said back;

said synchronous lifting mechanism is disposed at said top of said back (10); and wherein (i) a pillow support adjusting apparatus is disposed at said top of said back (10); a bottom end of said pillow support (18) is engaged with a hinge (23) disposed at said top of said back (10); a R-shaped support tooth segment (20) rotating with said hinge (23) is disposed below said pillow support (18); and said R-shaped support tooth segment (20) is engageable with a support top segment (19);

(ii) bottom end of said pillow support (18) is connected with two drawer-type guide ways (24) disposed at said top of said back (10); a parallel support tooth block (25) is disposed between said guide ways (24); and said parallel support tooth block (25) is connected with a hinged support top block (26) for housing a spring; or (iii) bottom end of said pillow support (18) is engaged with a hinge (23) disposed at said top of said back (10); backside of said pillow support (18) is engaged with one end of a connecting rod (49); and the other end of said connecting rod (49) is engaged with a hydraulic or pneumatic cylinder (85).

8. A sitting and sleeping furniture, comprising:

a back (10) having a top and a bottom;

a sitting and sleeping platform (13);

a plurality of back columns (2);

a back column cross frame (5);

a plurality of sitting and sleeping platform frames (14);

a parallel mechanism for moving said bottom of said back (10) toward and away from said back columns (2), said parallel mechanism comprising a plurality of supporting arms and a supporting arm controller; and a synchronous lifting mechanism for moving said top of said back (10) up and down alongside said back columns (2), said synchronous lifting mechanism connects said top of said back (10) to said back columns (2);

wherein said back columns (2) are connected with said back column cross frame (5) whereby forming a back column framework;

said sitting and sleeping platform frames (14) are connected with said back column framework whereby forming a sitting and sleeping platform skeleton;

said parallel mechanism is set below said back and above said sitting and sleeping platform (13);

said synchronous lifting mechanism is adapted to cooperate with said parallel mechanism to keep said top of said back at a constant distance with respect to said bottom of said back; and said synchronous lifting mechanism is disposed at said top of said back (10); and wherein (i) an adjusting apparatus for adjusting the distance between said back (10) and said sitting and sleeping platform (13) is connected to said back column cross frame (5); said adjusting apparatus comprises an open cover (33) engaged with the outer diameter of said back column (2) and is connected to said back column cross frame (5); and a plurality of fasteners (45) is connected to said open cover (33); or (ii) said back column cross frame (5) comprises a sleeve (60), said sleeve being engaged with the outer diameter of said back column (2); said sleeve (60) is opened with a gear cavity (53) to engage with a synchronous gear wheel (52) connected by a rotating shaft (53); said synchronous gear wheel (52) is geared up with a spur rack (51) disposed on said back column (2); and said sleeve (60) is also connected to a positioning cam spanner (59) for adjusting the distance between said back (10) and said sitting and sleeping platform (13).

9. A sitting and sleeping furniture, comprising:

a plurality of backs (10) having a top and a bottom;

a sitting and sleeping platform (13);

a plurality of back columns (2);

a back column cross frame (5);

a plurality of sitting and sleeping platform frames (14);

a parallel mechanism for moving said bottom of said back (10) toward and away from said back columns (2), said parallel mechanism comprising a plurality of supporting arms and a supporting arm controller; and a synchronous lifting mechanism for moving said top of said back (10) up and down alongside said back columns (2), said synchronous lifting mechanism connects said top of said back (10) to said back columns (2);

wherein said back columns (2) are connected with said back column cross frame (5) whereby forming a back column framework;

said sitting and sleeping platform frames (14) are connected with said back column framework whereby forming a sitting and sleeping platform skeleton;

said parallel mechanism is set below said back and above said sitting and sleeping platform (13);

said synchronous lifting mechanism is adapted to cooperate with said parallel mechanism to keep said top of said back at a constant distance with respect to said bottom of said back; and said synchronous lifting mechanism is disposed at said top of said back (10); and at least one middle column (56) having two guide paths is disposed between said back columns (2); said middle column (56) is connected to said back column cross frame (5); and said backs (10) are disposed between said back column (2) and said middle column (56).

* * * * *